US006768314B2

(12) United States Patent
Shimizu et al.

(10) Patent No.: US 6,768,314 B2
(45) Date of Patent: Jul. 27, 2004

(54) METHOD FOR DETECTING IMPROPER CONNECTION OF CONNECTOR

(75) Inventors: Naohiko Shimizu, Shiga (JP); Eiji Yanagi, Kanagawa (JP)

(73) Assignee: Takata Corporation, Tokyo (JP)

( * ) Notice: Subject to any disclaimer, the term of this patent is extended or adjusted under 35 U.S.C. 154(b) by 73 days.

(21) Appl. No.: 10/124,313

(22) Filed: Apr. 18, 2002

(65) Prior Publication Data

US 2002/0153900 A1 Oct. 24, 2002

(30) Foreign Application Priority Data

Apr. 18, 2001 (JP) ..... 2001-118986

(51) Int. Cl.[7] ..... H01H 31/04
(52) U.S. Cl. ..... 324/538; 324/66; 340/687
(58) Field of Search ..... 324/66, 538, 537, 324/511, 523, 524, 764; 280/735; 180/268; 340/686.1, 687, 568.1, 568.2, 568.3, 568.4, 572.1; 702/33, 35, 36, 58, 73

(56) References Cited

U.S. PATENT DOCUMENTS 5,781,121 A * 7/1998 Kawamura ..... 340/5.26
5,873,990 A * 2/1999 Wojciechowski et al. ... 204/406
6,002,331 A * 12/1999 Laor ..... 340/539.1

* cited by examiner

*Primary Examiner*—N. Le
*Assistant Examiner*—Vincent Q. Nguyen
(74) *Attorney, Agent, or Firm*—Kanesaka & Takeuchi

(57) ABSTRACT

In order to provide a method for reliably detecting that an operation device, such as a sensor or an actuator, is connected to a proper connector of a control device, a connection detecting method includes the steps of reading an identification signal of the operation device, comparing the identification signal with a predetermined signal assigned to the operation device at the control device, and determining if the identification signal matches the predetermined signal. The system also includes a step of sending a connection failure warning after the determining step is repeated for predetermined times.

5 Claims, 3 Drawing Sheets

METHOD FOR DETECTING IMPROPER CONNECTION OF CONNECTOR

BACKGROUND OF THE INVENTION AND RELATED ART STATEMENT

The present invention relates to a method for determining whether or not connectors, through which a control device is connected to various sensors, actuators and the like, are properly connected in an airbag inflation control system, a seat-belt pretension system, and the like of a car.

Cars are provided with various safety devices for ensuring the safety of passengers in the event of an accident such as a collision. Examples of the devices are an airbag device and a seat belt device. The former protects a passenger by inflating an airbag when an accident, such as a collision, is detected. The latter protects a passenger by a seat belt firmly restraining the passenger in the seat when the accident, such as the collision, is detected or anticipated.

In order for such an airbag device or seat belt device to operate as intended, a control device (Electronic Control Unit; hereinafter referred to as "ECU") is installed. Various sensors are provided so as to send necessary information for these ECUs to detect or anticipate an accident, or to determine a control mode. Such sensors include, for example, a seat load meter, an acceleration sensor, an inter-vehicle distance or vehicle gap sensor, a seat-belt tension sensor, and a passenger detection sensor.

Normally, signals from these sensors are transmitted to connectors on a housing of the ECU via cables. Similarly, actuators, such as an airbag device and a seat-belt winding device, are normally connected to the housing of the ECU by connectors via cables. When signals from the sensors and actuators are thus connected to the housing of the ECU, it is possible that connectors connected to cables of certain sensors or actuators may not be connected to correct connectors disposed on the housing of the ECU, that is, connected to connectors to which another sensor or actuator is supposed to be connected.

Such an event may occur even in general electric devices. Common measures against such an event are to use connectors with different shapes and to place pins at different positions so that each connector can not be mechanically connected to wrong connectors.

The above measures, however, are not perfect solution. For example, in a case in which a wrong connector is inadvertently attached to a cable of a sensor, when the sensor is connected to an ECU, it can be connected to a wrong position of the ECU. As a result, the sensor is connected to a signal line of another sensor or actuator. In such a case, of course, the ECU can not operate properly.

The present invention has been made in view of such circumstances, and an object of the invention is to provide a method for reliably ensuring that a device, such as a sensor or an actuator, is connected to a proper connector on a control device, and if the device is connected to a wrong connector, such a wrong connection is surely detected.

Further objects and advantages of the invention will be apparent from the following description of the invention.

SUMMARY OF THE INVENTION

To solve the above problems, the present invention provides a method for detecting a connector that improperly connects a device, such as a sensor, to a control device. In the method, the device is provided with an electrical identification signal, and the control device reads the identification signal of the device via the connector. Accordingly, it can be determined that the connector is improperly connected when a correspondence between the connector and the identification of the device is not normal.

In the method, the control device reads the identification signals of various devices via connectors, and determines that the connector is improperly connected when the correspondence between the connector and the device is not normal. This makes it possible to reliably detect that a certain device is connected to an improper connector, and to prevent the control device from malfunctioning.

DETAILED DESCRIPTION OF PREFERRED EMBODIMENTS

Figure 1:
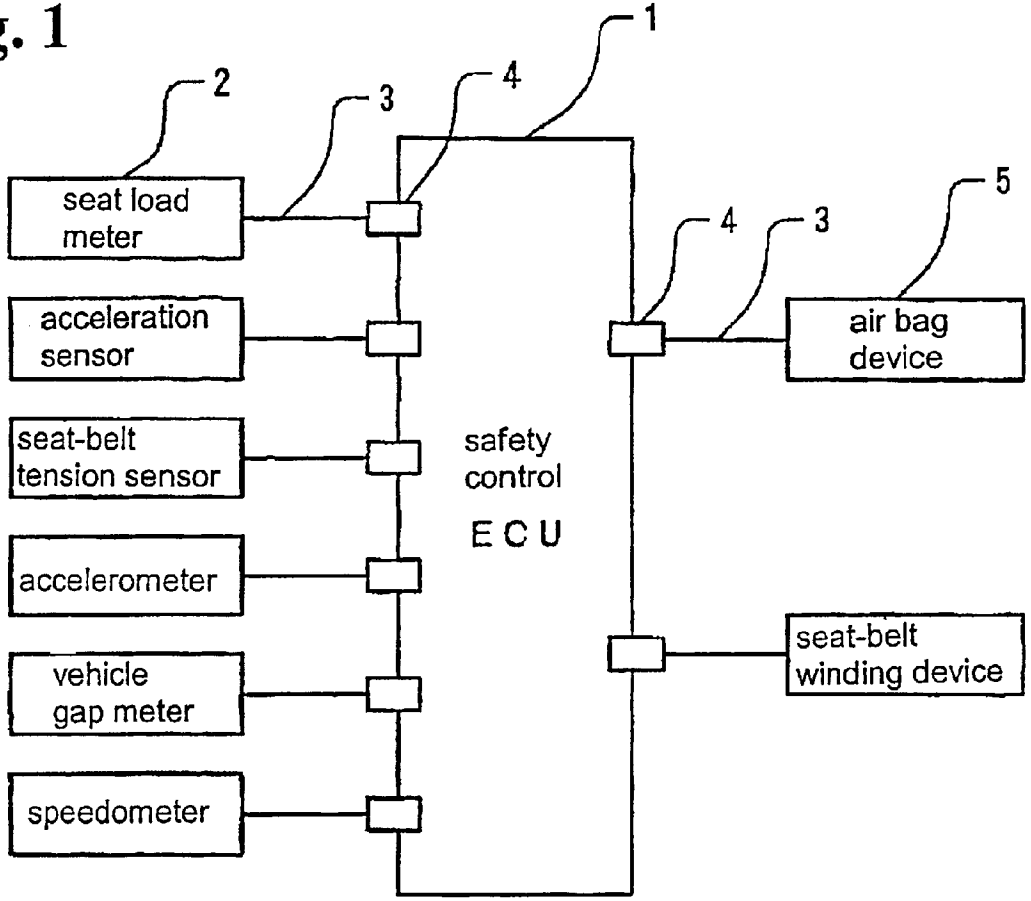
FIG. 1 is a diagram schematically showing an example of a configuration of a vehicle safety control system.

Hereunder, embodiments of the present invention will be described below with reference to the accompanied drawings. FIG. 1 is a diagram schematically showing an example of a configuration of a vehicle safety control system.

A vehicle safety control ECU 1 serving as an essential part of the system is mainly formed of a microcomputer. The safety control ECU 1 detects and anticipates a collision and the like in response to signals from various sensors 2, thereby controlling actuators 5, such as an airbag device and a seat-belt winding device. In this embodiment, a seat load meter, an acceleration sensor, a seat-belt tension sensor, an accelerometer, a vehicle gap meter, and a speedometer are used as the sensors 2. An airbag device and a seat-belt winding device are used as the actuators 5.

The sensors 2 and the actuators 5 are connected by cables 3, and the cables 3 and a housing of the safety control ECU 1 are connected by connectors 4.

Figure 2:
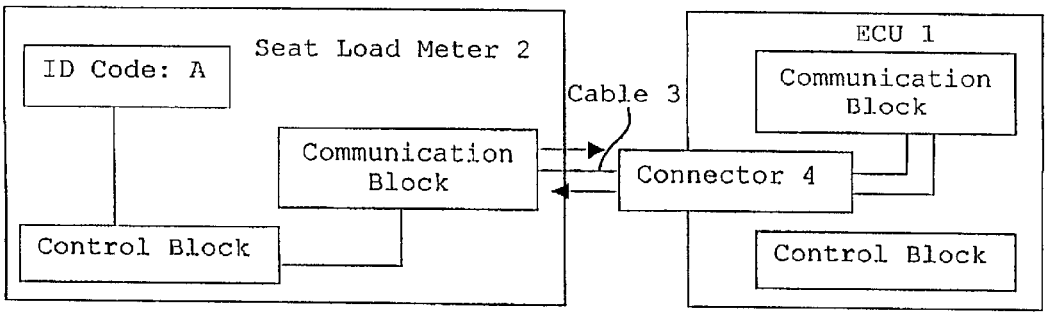
FIG. 2 is a block diagram for showing one example of a sensor and a control device.

As shown in FIG. 2, one sensor 2, e.g. seat load meter, includes a control block having an ID code, and a communication block connected to the control block. Also, the ECU 1 includes a control block, and a communication block connected to the connector 4. The communication block of the seat load meter is connected to the ECU 1 through the connector 4 and the cable 3.

Figure 3:
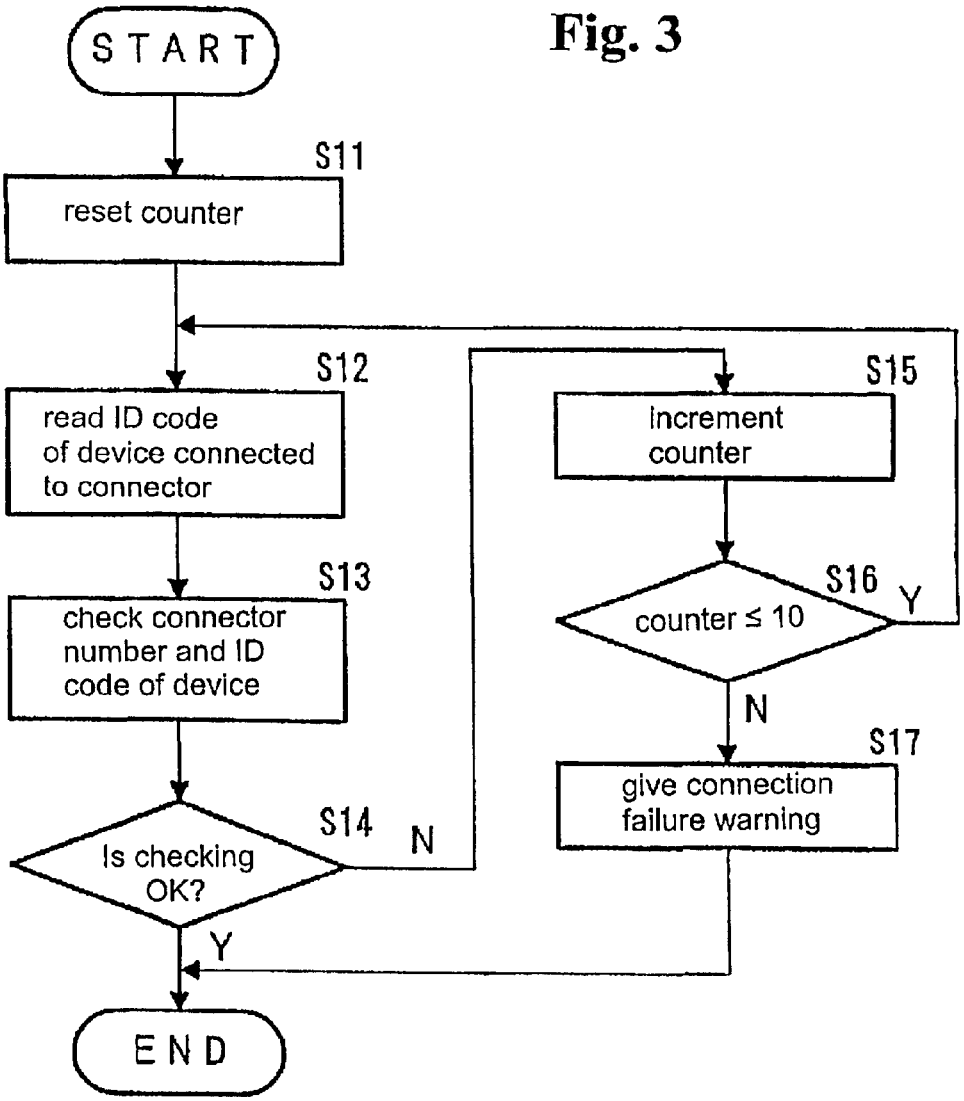
FIG. 3 is a flow chart showing operations of a safety control ECU for checking whether or not a proper sensor or actuator is connected to a connector of a housing of the safety control ECU.

FIG. 3 is a flow chart showing operations of the safety control ECU 1 for checking whether or not a proper sensor or actuator is connected to a connector on the housing of the safety control ECU 1. The flow chart automatically starts at every predetermined time, or in response to an external start signal (for example, when a person depresses a push button). While FIG. 2 shows a flow of diagnosis for one connector, the operation, of course, is performed for each of the connectors, as necessary.

First, a counter is reset in Step S11. An identification (ID) code number of a device (sensor or actuator) connected to a predetermined connector is read in Step S12. Specifically, the communication block in the safety control ECU 1 sends a command to the device to send its ID code back to the safety control ECU 1. Upon receipt of the command, the control block in the device recognizes the demand and sends its ID code back to the communication block in the safety control ECU 1. Then, a connector number is compared to the read ID number of the device in Step S13, and it is determined in Step S14 whether or not they are matched. When the two numbers are matched, the process is completed.

When the two numbers are not matched, a counter is incremented by one in Step S15, and it is checked in Step S16 if the value of the counter is less than or equal to a predetermined number, for example, 10. In this case, when the value is less than or equal to 10, the same operation as in Step S12 and subsequent steps are repeated. Since the safety control ECU 1 and the devices are connected electrically, there are several factors, such as an electrical noise from outside, that interfere the connection. Repetition in Step S16 ensures the disparity is a result of improper connection, not any other interference. When the value of the counter is more than 10, a connection failure warning is sent in Step S17, and the process is completed. The predetermined number, of course, is not limited to 10, and may be more or less than 10.

All the meters and sensors are sequentially checked by repeating the above method. Thus, by checking the number of the connector and the ID code number of the device connected thereto, it is possible to reliably detect that the device is connected to a right connector.

As described above, in the present invention, it is possible to reliably detect that the device is connected to a correct or wrong connector, and to prevent the control device from malfunctioning.

While the invention has been explained with reference to the specific embodiments of the invention, the explanation is illustrative and the invention is limited only by the appended claims.

What is claimed is:

1. A connection detecting method for detecting a proper connection between an operation device and a control device, comprising:

providing an identification signal to the operation device, sending from the control device to the operation device a command for sending the identification signal back to the control device, reading the identification signal of the operation device at the control device through a connector upon receipt of the command, comparing the identification signal with a predetermined signal assigned to the connector already in the control device, and determining that the operation device is properly connected to the control device if the identification signal matches the predetermined signal.

2. A connection detecting method according to claim 1, wherein said identification signal is compared with the predetermined signal repeatedly if the identification signal does not match the predetermined signal.

3. A connection detecting method according to claim 2, further comprising sending a connection failure warning if the identification signal does not match the predetermined signal after the comparing step repeated for predetermined times.

4. A connection detecting method according to claim 1, wherein said operation device is a seat load meter.

5. A connection detecting method according to claim 1, wherein said operation device includes a control block for providing the identification signal and a communication block electrically connected to the control block, said communication block communicating with the control device.

* * * * *